US011568813B1

(12) United States Patent
Ahn et al.

(10) Patent No.: US 11,568,813 B1
(45) Date of Patent: Jan. 31, 2023

(54) PIXEL LEVEL BURN-IN COMPENSATION FOR LIGHT-EMITTING DIODE BASED DISPLAYS

(71) Applicant: Meta Platforms Technologies, LLC, Menlo Park, CA (US)

(72) Inventors: Jeong-Keun Ahn, Palo Alto, CA (US); Zhiming Zhuang, Sammamish, WA (US); Min Hyuk Choi, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/741,044

(22) Filed: May 10, 2022

(51) Int. Cl.
*G09G 3/3241* (2016.01)

(52) U.S. Cl.
CPC ... *G09G 3/3241* (2013.01); *G09G 2320/0233* (2013.01); *G09G 2320/046* (2013.01)

(58) Field of Classification Search
None
See application file for complete search history.

(56) References Cited

U.S. PATENT DOCUMENTS

| | | | | |
|---|---|---|---|---|
| 7,619,593 | B2 | 11/2009 | Fish et al. | |
| 7,719,498 | B2 * | 5/2010 | Koyama | H01L 27/3262 345/82 |
| 9,552,765 | B2 | 1/2017 | Lee et al. | |
| 10,102,784 | B2 * | 10/2018 | Wang | G09G 3/3233 |
| 10,380,946 | B2 * | 8/2019 | Liu | G09G 3/3233 |
| 10,872,566 | B2 | 12/2020 | Qu et al. | |
| 10,877,276 | B1 * | 12/2020 | Pappas | G06F 3/0346 |
| 2006/0054893 | A1 * | 3/2006 | Nathan | G09G 3/3233 257/E27.111 |
| 2012/0162176 | A1 * | 6/2012 | Kim | G09G 3/3258 345/211 |
| 2015/0356915 | A1 | 12/2015 | Seo et al. | |
| 2016/0086534 | A1 | 3/2016 | Seo et al. | |
| 2016/0189604 | A1 | 6/2016 | Hu | |
| 2017/0263184 | A1 | 9/2017 | Chen et al. | |
| 2018/0130419 | A1 | 5/2018 | He et al. | |
| 2018/0197462 | A1 * | 7/2018 | Nagayama | G09G 3/32 |
| 2019/0025965 | A1 | 1/2019 | Yang et al. | |
| 2019/0073946 | A1 | 3/2019 | Su | |
| 2020/0402463 | A1 | 12/2020 | Wang | |
| 2021/0325987 | A1 | 10/2021 | Yang et al. | |
| 2022/0051633 | A1 | 2/2022 | Li et al. | |

* cited by examiner

*Primary Examiner* — Matthew Yeung
(74) *Attorney, Agent, or Firm* — Fenwick & West LLP

(57) ABSTRACT

Embodiments relate to a pixel circuit of a display with a pixel level burn-in compensation. The pixel circuit includes a light-emitting diode (LED), a first driving transistor between a voltage source and the LED, an enable transistor coupled to a gate electrode of the first driving transistor, and a second driving transistor connected between the voltage source and the LED. The first driving transistor provides first current from the voltage source to the LED according to a gate voltage of the first driving transistor. The enable transistor turns on responsive to a voltage level at an anode of the LED increasing to a threshold voltage level. The second driving transistor provides second current from the voltage source to the LED according to a version of the gate voltage of the first driving transistor received at a gate electrode of the second driving transistor via the enable transistor.

20 Claims, 7 Drawing Sheets

PIXEL LEVEL BURN-IN COMPENSATION FOR LIGHT-EMITTING DIODE BASED DISPLAYS

FIELD OF THE INVENTION

The present disclosure relates generally to display circuits, and specifically relates to a pixel level burn-in compensation for light-emitting diode based displays.

BACKGROUND

An organic light-emitting diode (OLED) based display suffers from burn-in and deterioration of performance with its use over time. To compensate for burn-in globally (i.e., for the entire display) or individually (i.e., for individual pixels), current flowing through an OLED in a pixel circuit is increased by raising a gate voltage of a driving transistor of the pixel circuit. However, this approach requires a higher supply voltage for the pixel circuit, which leads to an increase in power consumption.

SUMMARY

Embodiments of the present disclosure relate to a pixel circuit of a display assembly with a pixel level (i.e., per pixel) burn-in compensation that does not increase power consumption. The pixel circuit includes a light-emitting diode (LED), a first driving transistor between a voltage source (VDD) and the LED, an enable transistor coupled to a gate electrode of the first driving transistor, a gate transistor coupled to the enable transistor via the gate electrode of the first driving transistor, and a second driving transistor connected between the voltage source and the LED. The first driving transistor provides first current from the voltage source to the LED according to a gate voltage of the first driving transistor. The enable transistor turns on responsive to a voltage level at an anode of the LED increasing to a threshold voltage level. The gate transistor provides the gate voltage of the first driving transistor according to a data signal received at a source electrode of the gate transistor. The second driving transistor provides second current from the voltage source to the LED according to a version of the gate voltage of the first driving transistor received at a gate electrode of the second driving transistor via the enable transistor.

In one or more embodiments, the LED is implemented as an organic light emitting diode (OLED). In one or more other embodiments, the LED is implemented as a micro-LED.

In one or more embodiments, the pixel circuit is integrated into a display assembly comprising an array of pixel circuits, where each of the pixel circuits having a same structure as the pixel circuit. The display assembly may be part of a headset.

BRIEF DESCRIPTION OF THE DRAWINGS

Figures

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments of the present disclosure relate to a pixel circuit in a display panel with a pixel level (i.e., per pixel) burn-in compensation that does not increase power consumption. An organic light emitting diode (OLED) based display panel suffers from burn-in and deterioration of performance with its use over time. Each pixel circuit of the OLED display panel includes an additional enable transistor that is turned on when a respective OLED in each pixel circuit degrades. The enable transistor is implemented as a N-channel metal-oxide-semiconductor (NMOS) transistor so that the enable transistor is turned on when a voltage level at an anode of the OLED rises due to degradation of the OLED. When the enable transistor is turned on, an auxiliary driving transistor is also turned on to provide additional current to the OLED. In this way, the burn-in compensation at a pixel level (i.e., individually for each pixel circuit in the OLED display panel) can be accomplished without using any external signals.

The display panel presented herein may be integrated into a wearable device (e.g., headset), a mobile device, or any other hardware platform capable of providing artificial reality content to a user.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Figure 1A:
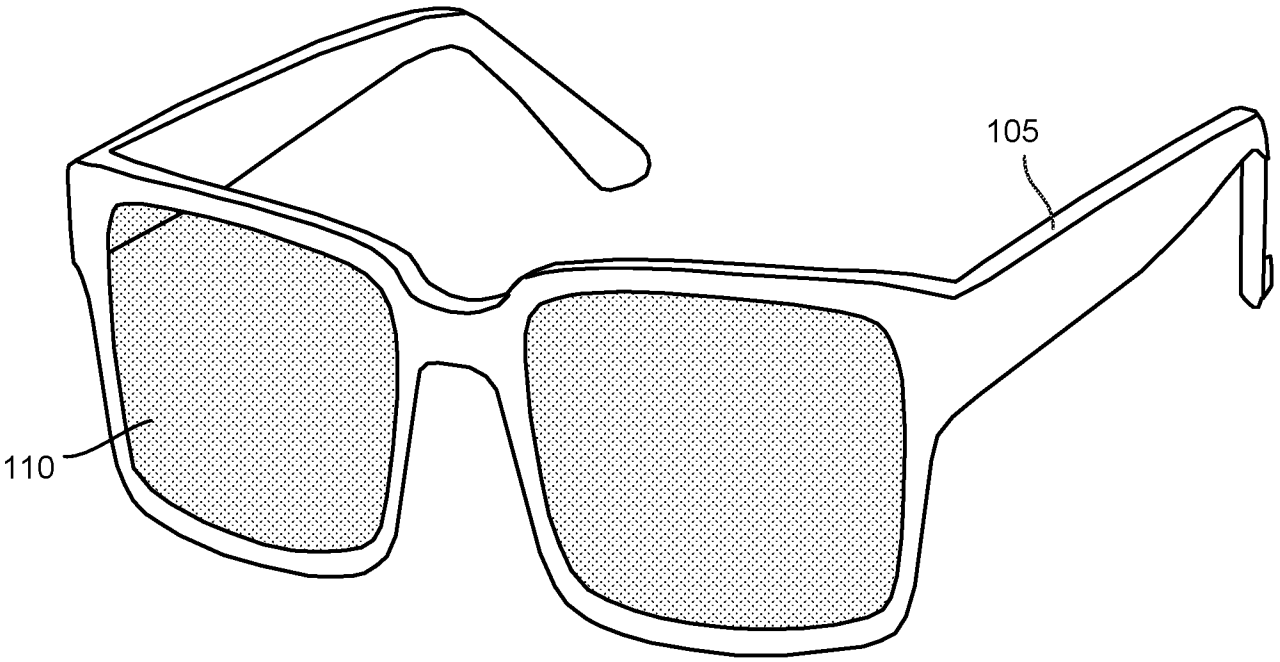
(FIGS. 1A and 1B are diagrams of head-mounted displays (HMDs) that include near-eye displays (NEDs), according to some embodiments.
Figure 1B:
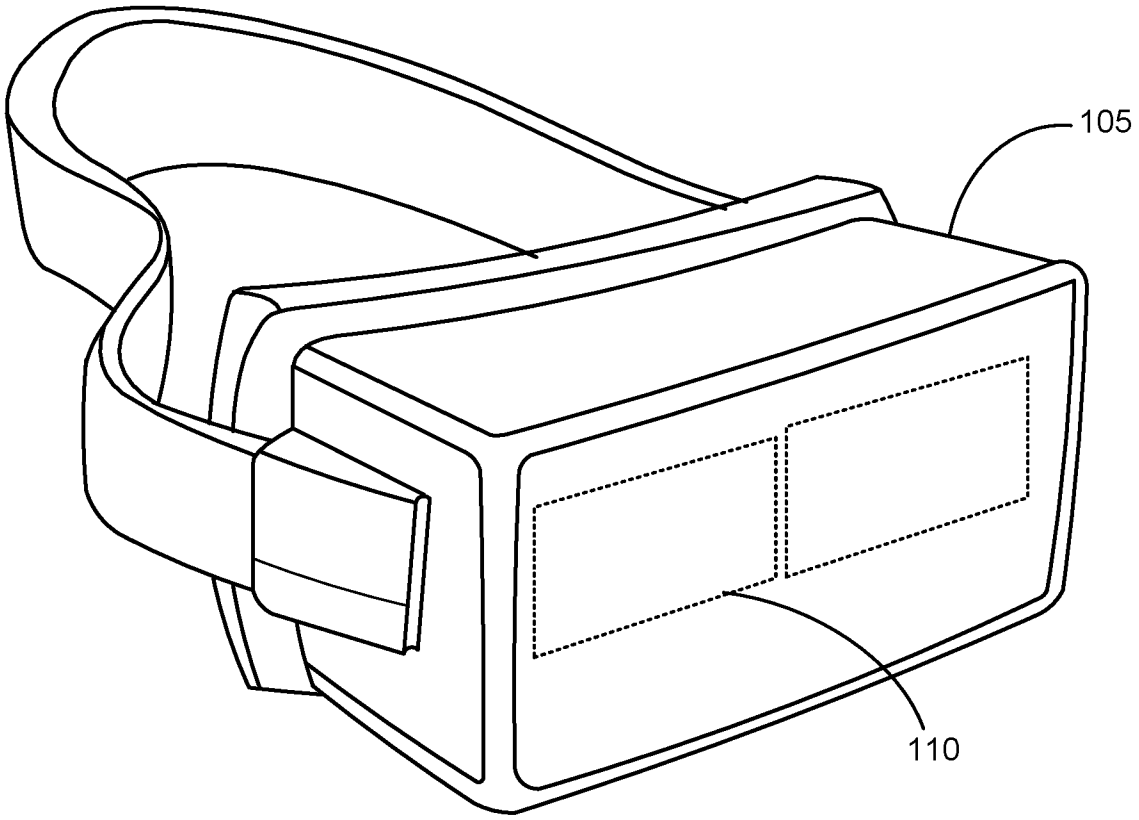

FIGS. 1A and 1B are diagrams of head-mounted displays (HMDs) 100 that include near-eye displays (NEDs) 110, according to some embodiments. The NED 110 may present media to a user. Examples of media that may be presented by the NED 110 include one or more images, video, audio, or some combination thereof. In some embodiments, audio may be presented via an external device (e.g., speakers and/or headphones) that receives audio information from the HMD 100, a console (not shown), or both, and presents audio data to the user based on the audio information. The HMD 100 is generally configured to operate as a virtual reality (VR) HMD. However, in some embodiments, the HMD 100 may be modified to also operate as an augmented reality (AR) HMD, a mixed reality (MR) HMD, or some combination thereof. For example, in some embodiments, the HMD 100 may augment views of a physical, real-world environment with computer-generated elements (e.g., still images, video, sound, etc.).

The HMD 100 shown in FIG. 1A or 1B may include a frame 105 and a display 110. The frame 105 may include one or more optical elements that together display media to a user. That is, the display 110 may be configured for a user to view the content presented by the HMD 100. As discussed below in conjunction with FIG. 2A, the display 110 may include at least one source assembly to generate image light to present optical media to an eye of the user. The source assembly may include, e.g., a source, an optics system, or some combination thereof.

FIGS. 1A and 1B are merely examples of a virtual reality system, and the display systems described herein may be incorporated into further such systems.

Figure 2A:
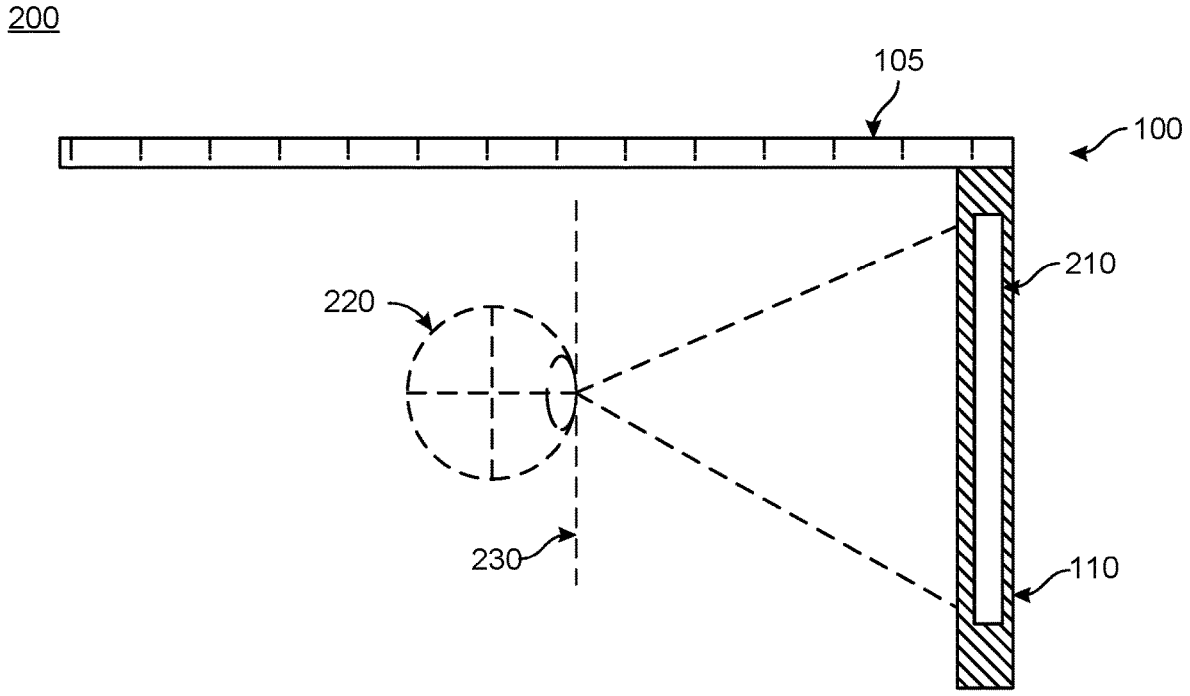
FIG. 2A is a cross-sectional view of the HMD illustrated in FIG. 1A or FIG. 1B, according to some embodiments.

FIG. 2A is a cross section 200 of the HMD 100 illustrated in FIG. 1A or FIG. 1B, according to some embodiments. The cross section 200 may include at least one display assembly 210, and an exit pupil 230. The exit pupil 230 is a location where an eye 220 may be positioned when a user wears the HMD 100. In some embodiments, the frame 105 may represent a frame of eye-wear glasses. For purposes of illustration, FIG. 2A shows the cross section 200 associated with a single eye 220 and a single display assembly 210, but in alternative embodiments not shown, another display assembly that is separate from or integrated with the display assembly 210 shown in FIG. 2A, may provide image light to another eye of the user.

The display assembly 210 may direct the image light to the eye 220 through the exit pupil 230. The display assembly 210 may be composed of one or more materials (e.g., plastic, glass, etc.) with one or more refractive indices that effectively decrease the weight and widen a field of view of the HMD 100.

In alternate configurations, the HMD 100 may include one or more optical elements (not shown) between the display assembly 210 and the eye 220. The optical elements may act to, by way of various examples, correct aberrations in image light emitted from the display assembly 210, magnify image light emitted from the display assembly 210, perform some other optical adjustment of image light emitted from the display assembly 210, or combinations thereof. Example optical elements may include an aperture, a Fresnel lens, a convex lens, a concave lens, a filter, or any other suitable optical element that may affect image light.

In some embodiments, the display assembly 210 may include a source assembly to generate image light to present media to a user's eyes. The source assembly may include, e.g., a light source, an optics system, or some combination thereof. In accordance with various embodiments, a source assembly may include a light-emitting diode (LED) such as an organic light-emitting diode (OLED). In accordance with various embodiments, the display assembly 210 may be implemented as an OLED display assembly, or some other type of LED-based display assembly configured to emit color image light to the eye 220.

Figure 2B:
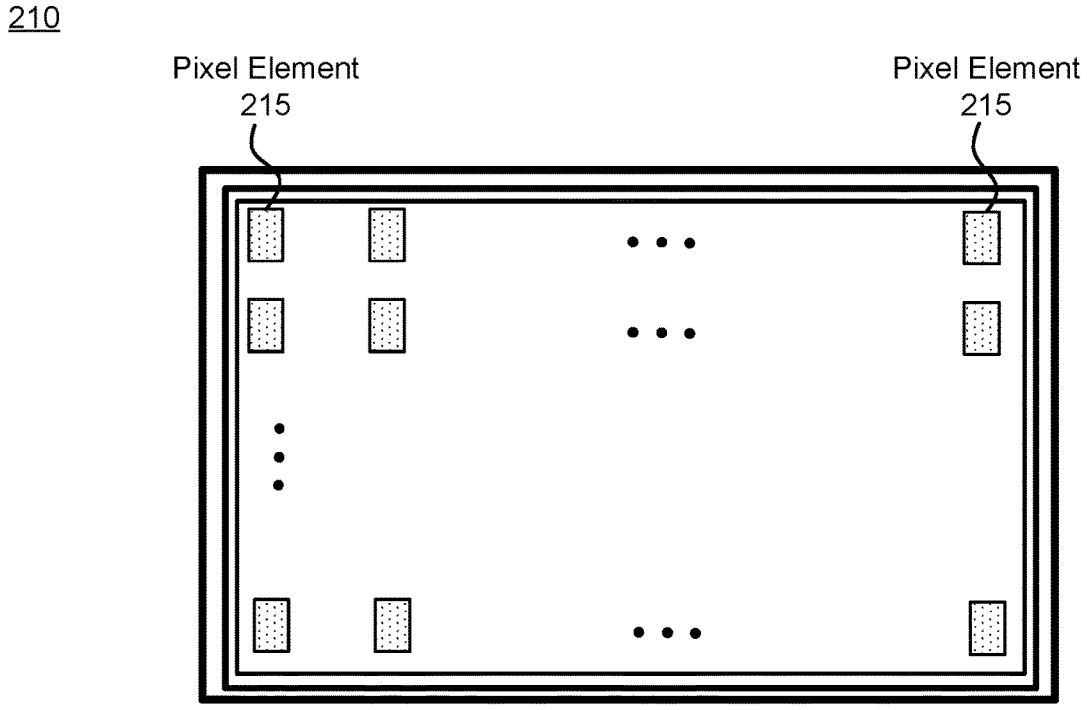
FIG. 2B is an example display with an array of pixel elements, in accordance with one or more embodiments.

FIG. 2B is an example display assembly 210 with an array of pixel elements 215, according to some embodiments. Each pixel element 215 in the array may have a same structure (not shown in FIG. 2B). In some embodiments, each pixel element 215 may emit a portion of image light comprising a plurality of color components (e.g., red, green and blue color components). Each pixel element 215 may comprise multiple pixel circuits (e.g., three pixel circuits) of a same structure, and each pixel circuit in the pixel element 215 may emit light of a corresponding color component (e.g., red color, green color, or blue color). In some other embodiments, each pixel element 215 may comprise a single pixel circuit emitting light of a specific intensity (i.e., gray level). The burn-in compensation at the display assembly 210 can be achieved by activating a burn-in compensation individually for each pixel circuit of each pixel element 215 in the display assembly 210. Details about a structure of pixel circuit of a pixel element 215 and activation of a pixel level burn-in compensation are described below in conjunction with FIGS. 3A through 5.

Figure 3A:
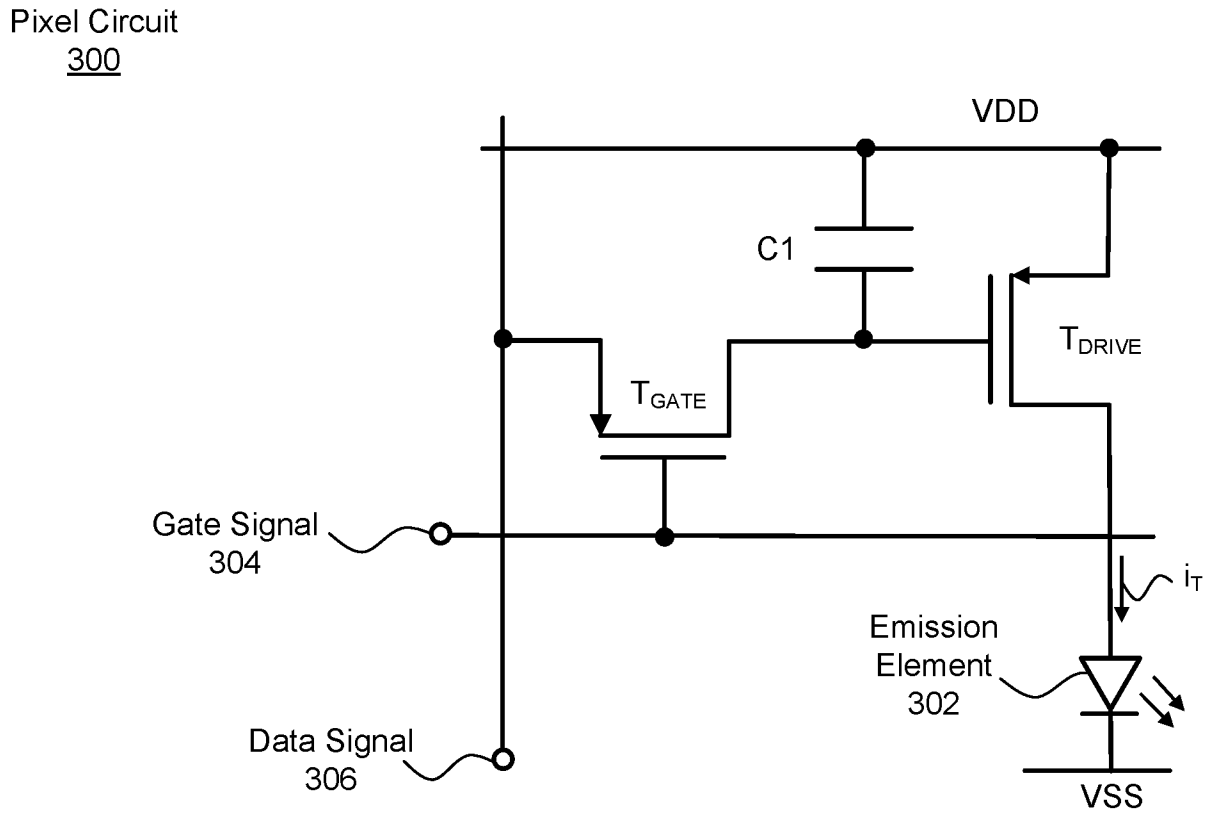
FIG. 3A is an example schematic of a pixel circuit with a single driving transistor, according to some embodiments.

FIG. 3A is an example schematic of a pixel circuit 300 with a single driving transistor $T_{DRIVE}$, according to some embodiments. The driving transistor $T_{DRIVE}$ provides a current $i_T$ from a first voltage source (VDD or high supply voltage) to an emission element 302 of the pixel circuit 300 according to a gate voltage of the driving transistor $T_{DRIVE}$. The driving transistor $T_{DRIVE}$ is between the first voltage source VDD and the emission element 302 that is further coupled to a second voltage source (VSS or low supply voltage).

The emission element 302 emits light having an intensity level in accordance with a level of current $i_T$ through the emission element 302. The emission element 302 may be implemented as a LED, micro-LED, OLED, or some other element that emits light based a level of current flowing through the emission element 302. The light emitted by the emission element 302 may be light of a specific color component (e.g., red light, green light, or blue light). Alternatively, the light emitted by the emission element 302 may be monochrome light (i.e., gray light).

The pixel circuit 300 further includes a gate transistor $T_{GATE}$ coupled to a gate electrode of the driving transistor $T_{DRIVE}$. The gate transistor $T_{GATE}$ may control the voltage at the gate electrode of the driving transistor $T_{DRIVE}$ (i.e., the gate voltage). The gate transistor $T_{GATE}$ is turned on when a gate signal 304 provided to a gate electrode of the gate transistor $T_{GATE}$ turns low. After the gate transistor $T_{GATE}$ is turned on, a voltage at the gate electrode of the driving transistor $T_{DRIVE}$ (which also corresponds to a voltage at a drain electrode of the gate transistor $T_{GATE}$) is determined by a level of a data signal 306 provided to a source electrode of the gate transistor $T_{GATE}$. Thus, a level of current $i_T$ provided by the driving transistor $T_{DRIVE}$ to the emission element 302 depends on a level of the data signal 306. The gate voltage of the driving transistor $T_{DRIVE}$ that determines the level of current may be further stabilized by connecting a capacitor C1 between the first voltage source VDD and the gate electrode of the driving transistor $T_{DRIVE}$.

Figure 3B:
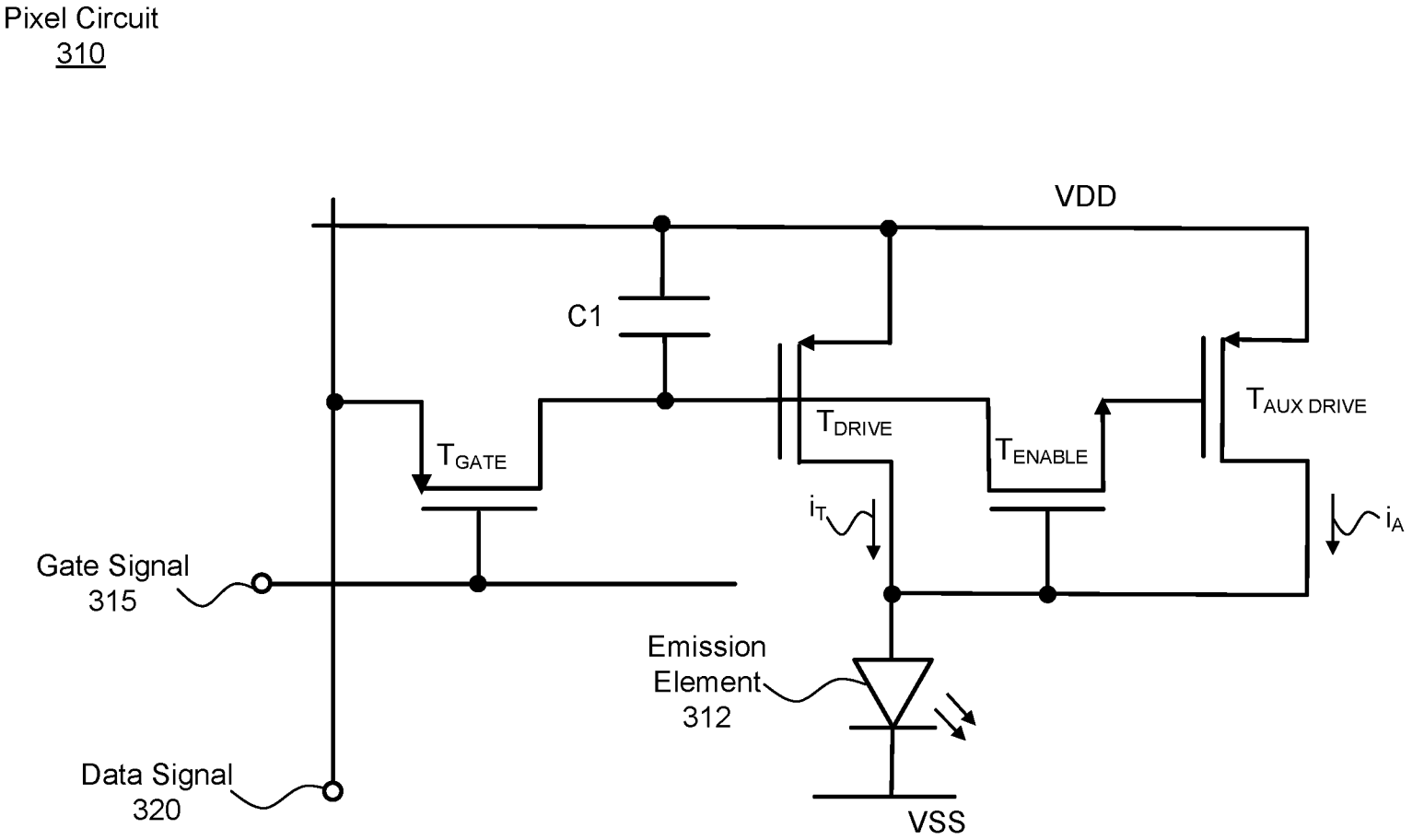
FIG. 3B is an example schematic of a pixel circuit with a pair of driving transistors for a pixel level burn-in compensation, according to some embodiments.

FIG. 3B is an example schematic of a pixel circuit 310 with a pair of driving transistors $T_{DRIVE}$, $T_{AUX\ DRIVE}$ for a pixel level burn-in compensation, according to some embodiments. The pixel circuit 310 includes a first driving transistor $T_{DRIVE}$, a second (i.e., auxiliary) driving transistor $T_{AUX\ DRIVE}$, a gate transistor $T_{GATE}$, an enable transistor $T_{ENABLE}$, and an emission element 312. The first driving transistor $T_{DRIVE}$ may be a P-channel metal-oxide-semiconductor (PMOS) transistor, the enable transistor $T_{ENABLE}$ may be a N-channel metal-oxide-semiconductor (NMOS) transistor, the gate transistor $T_{GATE}$ may be a PMOS transistor, and the second driving transistor $T_{AUX\ DRIVE}$ may be a PMOS transistor.

Compared to the embodiment of pixel circuit 300 of FIG. 3A, the second driving transistor $T_{AUX\ DRIVE}$ and the enable transistor $T_{ENABLE}$ are included at the pixel circuit 310 to provide an additional (i.e., auxiliary or second) current $i_A$ to the emission element 312. The first driving transistor $T_{DRIVE}$ provides a first current $i_T$ from a first voltage source (VDD or high supply voltage) to the emission element 312 according to a gate voltage of the first driving transistor $T_{DRIVE}$. The first driving transistor $T_{DRIVE}$ is between the first voltage source VDD and the emission element 312 that is further coupled to a second voltage source (VSS or low supply voltage or ground).

The emission element 312 emits light having an intensity level in accordance with a level of first current $i_T$ that flows from the first voltage source VDD and through the first driving transistor $T_{DRIVE}$ to the emission element 312. The emission element 312 may be implemented as a LED, micro-LED, OLED, or some other element that emits light based a level of current flowing through the emission element 312. The light emitted by the emission element 312 may be light of a specific color component (e.g., red light, green light, or blue light). Alternatively, the light emitted by the emission element 312 may be monochrome light (i.e., gray light).

The gate transistor $T_{GATE}$ controls a voltage level at a gate electrode of the first driving transistor $T_{DRIVE}$, as well as at a gate electrode of the second driving transistor $T_{AUX\ DRIVE}$ (when the enable transistor $T_{ENABLE}$ is turned on). The gate transistor $T_{GATE}$ is turned on when a gate signal 315 provided to a gate electrode of the gate transistor $T_{GATE}$ turns low. After the gate transistor $T_{GATE}$ is turned on, a voltage level at the gate electrode of the first driving transistor $T_{DRIVE}$ (which also corresponds to a voltage at a drain electrode of the gate transistor $T_{GATE}$) is determined by a level of a data signal 320 provided to a source electrode of the gate transistor $T_{GATE}$. Thus, a level of first current $i_T$ provided by the first driving transistor $T_{DRIVE}$ to the emission element 312 depends on a level of the data signal 320. The gate voltage of the first driving transistor $T_{DRIVE}$ that determines the level of first current $i_T$ (as well as a level of second current $i_A$) may be further stabilized by connecting a capacitor C1 between the first voltage source VDD and the gate electrode of the first driving transistor $T_{DRIVE}$.

When turned on, the enable transistor $T_{ENABLE}$ provides the burn-in compensation for the emission element 312. The enable transistor $T_{ENABLE}$ provides a version of the gate voltage of the first driving transistor $T_{DRIVE}$ to a gate electrode of the second driving transistor $T_{AUX\ DRIVE}$ (e.g., the gate voltage of the first driving transistor $T_{DRIVE}$ decreased by a voltage drop across the enable transistor $T_{ENABLE}$). The enable transistor $T_{ENABLE}$ turns on responsive to a voltage level at an anode of the emission element 312 increasing to a threshold voltage level due to an increase of a resistance of the emission element 312 caused by deterioration of the emission element 312 over time. A threshold voltage between a gate electrode of the enable transistor $T_{ENABLE}$ and a source electrode of the enable transistor $T_{ENABLE}$ required for turning on the enable transistor $T_{ENABLE}$ can be configured to correspond to a voltage level at the anode of the emission element 312 when a level of luminosity of the emission element 312 decreases to a threshold luminosity level. The threshold luminosity level of the emission element 312 may be a luminosity level of approximately 95% of an original luminosity level of the emission element 312. The enable transistor $T_{ENABLE}$ can be thus configured to turn on responsive to a level of luminosity of the emission element 312 decreasing to the threshold luminosity level (e.g., to approximately 95% of the original luminosity level).

The turning-on of the enable transistor $T_{ENABLE}$ activates the burn-in compensation for the emission element 312 by activating the second driving transistor $T_{AUX\ DRIVE}$. A gate voltage of the second driving transistor $T_{AUX\ DRIVE}$ (which is also a source voltage of the enable transistor $T_{ENABLE}$) provided by the activated enable transistor $T_{ENABLE}$ turns on the second driving transistor $T_{AUX\ DRIVE}$. Like the first driving transistor $T_{DRIVE}$, the second driving transistor $T_{AUX\ DRIVE}$ is connected between the first voltage source VDD and the emission element 312, i.e., the first and second driving transistors $T_{DRIVE}$ and $T_{AUX\ DRIVE}$ are connected in parallel. The second driving transistor $T_{AUX\ DRIVE}$ provides second current ($i_A$) from the first voltage source VDD to the emission element 312 according to a version of the gate voltage of the first driving transistor $T_{DRIVE}$ received at a gate electrode of the second driving transistor $T_{AUX\ DRIVE}$ via the enable transistor $T_{ENABLE}$. Thus, when the enable transistor $T_{ENABLE}$ is turned on due to deterioration of the emission element 312 (i.e., when the burn-in compensation for the emission element 312 is activated), a combined current (i.e., the combination of first current $i_T$ and second current $i_A$) through the emission element 312 is increased from first current $i_T$ to a sum of first current and second current ($i_T+i_A$), thus providing the burn-in compensation to the emission element 312 without an increase in supply voltage.

The burn-in compensation of the emission element 312 is thus achieved for an individual pixel circuit 310 by adding the enable transistor $T_{ENABLE}$ and the second driving transistor $T_{AUX\ DRIVE}$ to the pixel circuit 310 (in comparison with the pixel circuit 300). Both the enable transistor $T_{ENABLE}$ and the second driving transistor $T_{AUX\ DRIVE}$ may have a small size—substantially smaller size (i.e., smaller width) compared to that of the first driving transistor $T_{DRIVE}$. For example, a size (e.g., width) of the second driving transistor $T_{AUX\ DRIVE}$ may be approximately eight times smaller than a size (e.g., width) of the first driving transistor $T_{DRIVE}$.

Figure 4A:
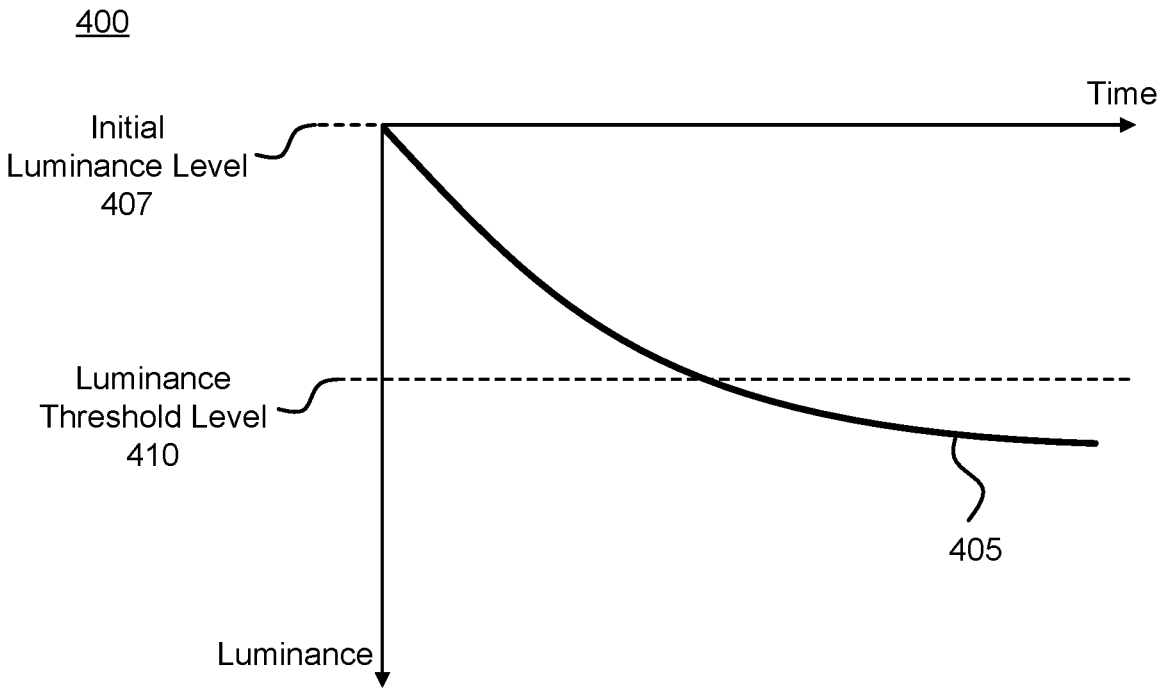
FIG. 4A is a graph of a luminance of an organic light emitting diode (OLED) over time without a burn-in compensation, according to some embodiments.

FIG. 4A is an example graph 400 of a luminance of an OLED over time without a burn-in compensation, in accordance with one or more embodiments. A plot 405 illustrates the OLED luminance as a function of time. It can be observed that the OLED luminance starts at an initial luminance level 407 and decreases over time. At some point in time, without the burn-in compensation, the OLED luminance decreases below a luminance threshold level 410 (e.g., approximately 95% of the initial luminance level 407) and continues to decrease. Hence, without the burn-in compensation, performance of the OLED continues to deteriorate over time.

Figure 4B:
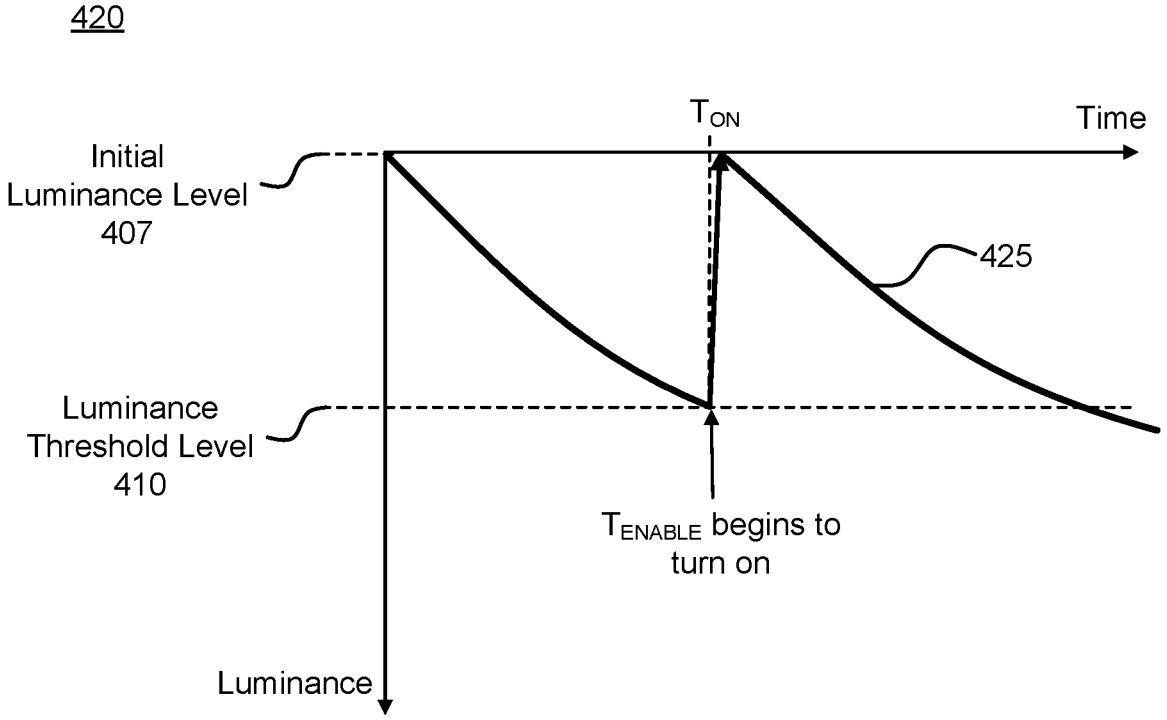
FIG. 4B is a graph of a luminance of an OLED over time with the burn-in compensation, according to some embodiments.

FIG. 4B is an example graph 420 of a luminance of an OLED over time with the burn-in compensation implemented at a pixel circuit (e.g., the pixel circuit 310) that integrates the OLED, in accordance with one or more embodiments. A plot 425 illustrates the OLED luminance as a function of time with the burn-in compensation implemented at the pixel circuit. Until a time $T_{ON}$, the OLED operates without the burn-in compensation. At the time $T_{ON}$ when the OLED luminance reaches the luminance threshold level 410 (e.g., approximately 95% of the initial luminance level 407), an enable transistor at the pixel circuit is turned on (i.e., enabled) responsive to a voltage level at an anode of the OLED increasing to a threshold voltage level, which further activates a second driving transistor at the pixel circuit that almost instantaneously increases a driving current for the OLED. Due to the increased driving current at the pixel circuit, the OLED luminance almost instantaneously increases approximately to the initial luminance level 407, as shown in FIG. 4B. After the time $T_{ON}$, the burn-in compensation is activated that provides a level of luminosity for the OLED above the luminance threshold level 410 for an extended time period in comparison with FIG. 4A when no burn-in compensation is implemented.

Figure 5:
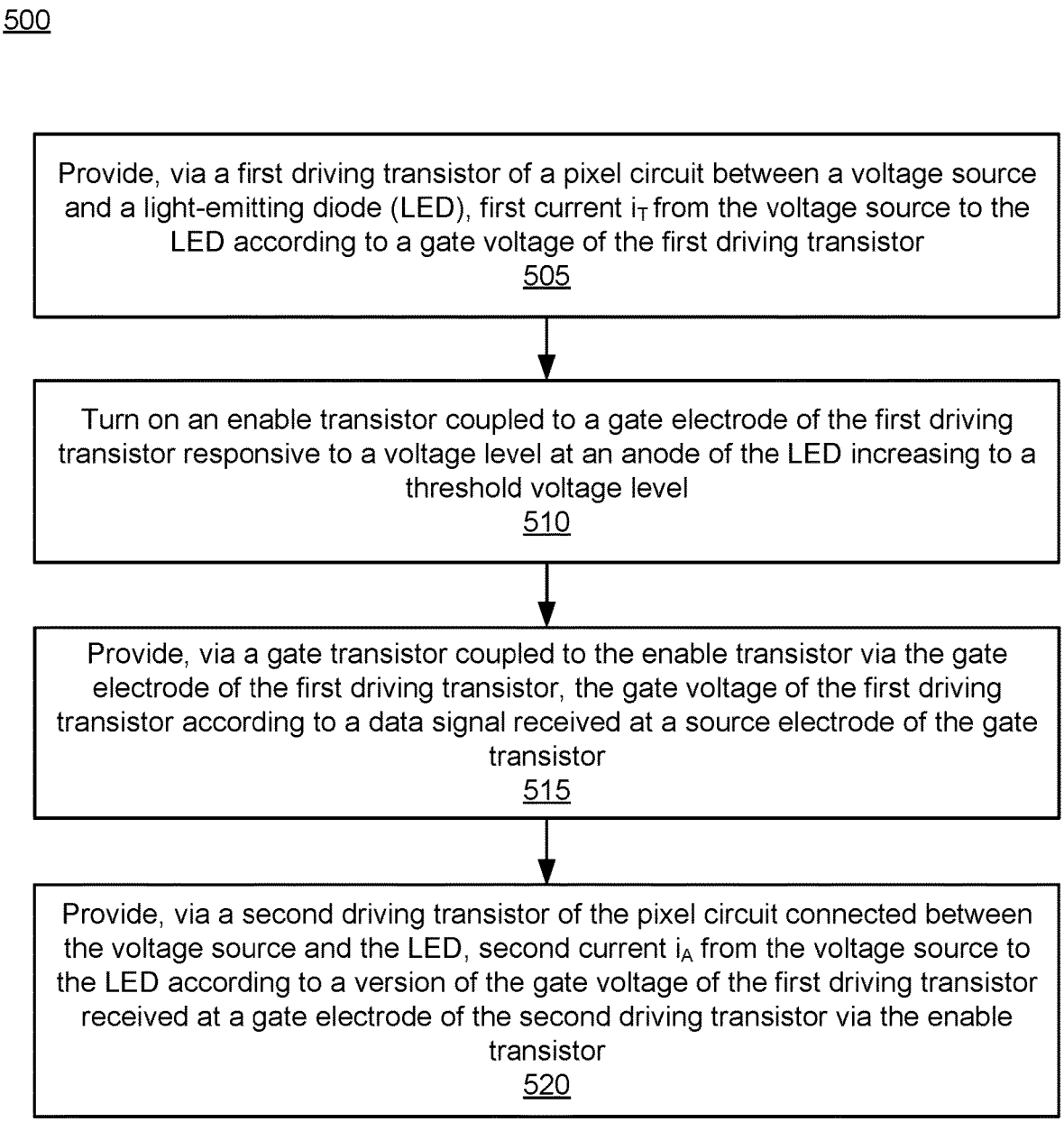
FIG. 5 is a flowchart illustrating a process for operating a pixel circuit in a display assembly for achieving a burn-in compensation at a pixel level, according to some embodiments.

FIG. 5 is a flowchart illustrating a process 500 for operating a pixel circuit (e.g., the pixel circuit 310) in a display assembly for achieving a burn-in compensation at a pixel level, according to some embodiments. The process 500 shown in FIG. 5 may be performed by components of the pixel circuit (e.g., components of the pixel circuit 310). The pixel circuit may be integrated into a display assembly comprising an array of pixel circuits, each of the pixel circuits having a same structure as the pixel circuit. Other entities may perform some or all of the steps in FIG. 5 in other embodiments. Embodiments may include different and/or additional steps, or perform the steps in different orders.

At 505, the pixel circuit provides, via a first driving transistor between a voltage source and a LED, first current $i_T$ from the voltage source to the LED according to a gate voltage of the first driving transistor. At 510, the pixel circuit turns on an enable transistor coupled to a gate electrode of the first driving transistor responsive to a voltage level at an anode of the LED increasing to a threshold voltage level. The enable transistor may be turned on in accordance with a threshold voltage between a gate electrode of the enable transistor and a source electrode of the enable transistor. The threshold voltage of the enable transistor may be configured such that the threshold voltage corresponds to the voltage level of the anode of the LED increasing to the threshold voltage level responsive to a level of luminosity of the LED decreasing to a threshold luminosity level.

At 515, the pixel circuit provides, via a gate transistor coupled to the enable transistor via the gate electrode of the first driving transistor, the gate voltage of the first driving transistor according to a data signal received at a source electrode of the gate transistor. At 520, the pixel circuit provides, via a second driving transistor connected between the voltage source and the LED, second current $i_A$ from the voltage source to the LED according to a version of the gate voltage of the first driving transistor received at a gate electrode of the second driving transistor via the enable transistor.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A pixel circuit comprising:

a light-emitting diode (LED);

a first driving transistor between a voltage source and the LED, the first driving transistor configured to provide first current from the voltage source to the LED according to a gate voltage of the first driving transistor;

an enable transistor coupled to a gate electrode of the first driving transistor, the enable transistor turning on responsive to a voltage level at an anode of the LED increasing to a threshold voltage level;

a gate transistor coupled to the enable transistor via the gate electrode of the first driving transistor, the gate transistor configured to provide the gate voltage of the first driving transistor according to a data signal received at a source electrode of the gate transistor; and a second driving transistor connected between the voltage source and the LED, the second driving transistor configured to provide second current from the voltage source to the LED according to a version of the gate voltage of the first driving transistor received at a gate electrode of the second driving transistor via the enable transistor.

2. The pixel circuit of claim 1, wherein a gate electrode of the enable transistor is connected to the anode of the LED, a drain electrode of the enable transistor is connected to the gate electrode of the first driving transistor and a drain electrode of the gate transistor, and a source electrode of the enable transistor is connected to the gate electrode of the second driving transistor.

3. The pixel circuit of claim 1, wherein the first driving transistor is a P-channel metal-oxide-semiconductor (PMOS) transistor, the enable transistor is a N-channel metal-oxide-semiconductor (NMOS) transistor, the gate transistor is a PMOS transistor, and the second driving transistor is a PMOS transistor.

4. The pixel circuit of claim 1, wherein the turning on of the enable transistor causes turning on of the second driving transistor.

5. The pixel circuit of claim 1, wherein a threshold voltage for turning on the enable transistor corresponds to a level of luminosity of the LED at a threshold luminosity level.

6. The pixel circuit of claim 5, wherein the threshold luminosity level is a luminosity level of approximately 95% of an original luminosity level of the LED.

7. The pixel circuit of claim 1, wherein the enable transistor turns on responsive to a level of luminosity of the LED decreasing to a threshold luminosity level.

8. The pixel circuit of claim 1, wherein a size of the second driving transistor is smaller than a size of the first driving transistor.

9. The pixel circuit of claim 1, wherein the pixel circuit is integrated into a display comprising an array of pixel circuits, each of the pixel circuits having a same structure as the pixel circuit.

10. A display assembly comprising:

an array of pixel circuits, each pixel circuit in the array comprising:

a light-emitting diode (LED);

a first driving transistor between a voltage source and the LED, the first driving transistor configured to provide first current from the voltage source to the LED according to a gate voltage of the first driving transistor;

an enable transistor coupled to a gate electrode of the first driving transistor, the enable transistor turning on responsive to a voltage level at an anode of the LED increasing to a threshold voltage level;

a gate transistor coupled to the enable transistor via the gate electrode of the first driving transistor, the gate transistor configured to provide the gate voltage of the first driving transistor according to a data signal received at a source electrode of the gate transistor; and a second driving transistor connected between the voltage source and the LED, the second driving transistor configured to provide second current from the voltage source to the LED according to a version of the gate voltage of the first driving transistor received at a gate electrode of the second driving transistor via the enable transistor.

11. The display assembly of claim 10, wherein a gate electrode of the enable transistor is connected to the anode of the LED, a drain electrode of the enable transistor is connected to the gate electrode of the first driving transistor and a drain electrode of the gate transistor, and a source electrode of the enable transistor is connected to the gate electrode of the second driving transistor.

12. The display assembly of claim 10, wherein the turning on of the enable transistor causes turning on of the second driving transistor.

13. The display assembly of claim 10, wherein a threshold voltage for turning on the enable transistor corresponds to a level of luminosity of the LED at a threshold luminosity level.

14. The display assembly of claim 10, wherein the enable transistor turns on responsive to a level of luminosity of the LED decreasing to a threshold luminosity level.

15. The display assembly of claim 10, wherein a size of the second driving transistor is smaller than a size of the first driving transistor.

16. A method for operating a pixel circuit, the method comprising:

providing, via a first driving transistor between a voltage source and a light-emitting diode (LED), first current from the voltage source to the LED according to a gate voltage of the first driving transistor;

turning on an enable transistor coupled to a gate electrode of the first driving transistor responsive to a voltage level at an anode of the LED increasing to a threshold voltage level;

providing, via a gate transistor coupled to the enable transistor via the gate electrode of the first driving transistor, the gate voltage of the first driving transistor according to a data signal received at a source electrode of the gate transistor; and providing, via a second driving transistor connected between the voltage source and the LED, second current from the voltage source to the LED according to a version of the gate voltage of the first driving transistor received at a gate electrode of the second driving transistor via the enable transistor.

17. The method of claim 16, further comprising:

turning on the enable transistor responsive to a level of luminosity of the LED decreasing to a threshold luminosity level.

18. The method of claim 16, further comprising:

turning on the second driving transistor responsive to turning on the enable transistor.

19. The method of claim 16, further comprising:

turning on the enable transistor in accordance with a threshold voltage between a gate electrode of the enable transistor and a source electrode of the enable transistor, the threshold voltage corresponding to a level of luminosity of the LED being at a threshold luminosity level.

20. The method of claim 16, further comprising:

turning on the gate transistor in accordance with a gate signal received at a gate electrode of the gate transistor; and turning on the first driving transistor responsive to turning on the gate transistor.

* * * * *